US009470436B2

(12) United States Patent
Takahashi et al.

(10) Patent No.: US 9,470,436 B2
(45) Date of Patent: Oct. 18, 2016

(54) CRYOGENIC REFRIGERATION APPARATUS AND METHOD OF CONTROLLING CRYOGENIC REFRIGERATION APPARATUS

(71) Applicant: Sumitomo Heavy Industries, Ltd., Tokyo (JP)

(72) Inventors: Kakeru Takahashi, Tokyo (JP); Takaaki Matsui, Tokyo (JP)

(73) Assignee: Sumitomo Heavy Industries, Ltd., Tokyo (JP)

( * ) Notice: Subject to any disclaimer, the term of this patent is extended or adjusted under 35 U.S.C. 154(b) by 106 days.

(21) Appl. No.: 14/196,853

(22) Filed: Mar. 4, 2014

(65) Prior Publication Data

US 2014/0245754 A1 Sep. 4, 2014

(30) Foreign Application Priority Data

Mar. 4, 2013 (JP) ..... 2013-041438

(51) Int. Cl.
*F25B 9/00* (2006.01)
*F25B 9/14* (2006.01)
*F25B 9/10* (2006.01)

(52) U.S. Cl.
CPC .. *F25B 9/14* (2013.01); *F25B 9/10* (2013.01); *F25B 2309/002* (2013.01)

(58) Field of Classification Search
CPC ..... F25B 9/14; F25B 9/145
USPC ..... 62/6; 60/517, 520
See application file for complete search history.

(56) References Cited

U.S. PATENT DOCUMENTS

| | | | | |
|---|---|---|---|---|
| 3,640,082 | A * | 2/1972 | Dehne | F02G 1/0445 417/439 |
| 4,471,625 | A * | 9/1984 | Yasukochi | F25B 9/14 60/520 |
| 6,308,520 | B1 | 10/2001 | Inoue et al. | |
| 6,655,154 | B2 | 12/2003 | Funayama et al. | |
| 8,261,562 | B2 | 9/2012 | Dresens et al. | |
| 2006/0101836 | A1 | 5/2006 | Tanaka | |

FOREIGN PATENT DOCUMENTS

| | | | |
|---|---|---|---|
| JP | H0315676 | A | 1/1991 |
| JP | H09229503 | A | 9/1997 |
| JP | H11-281181 | A | 10/1999 |
| JP | 2000-161802 | A | 6/2000 |
| JP | 2003-049770 | A | 2/2003 |
| JP | 3754992 | B2 | 3/2006 |
| JP | 2007-303815 | A | 11/2007 |
| TW | 200921031 | A | 5/2009 |

* cited by examiner

*Primary Examiner* — Melvin Jones
(74) *Attorney, Agent, or Firm* — Michael Best & Friedrich LLP

(57) ABSTRACT

A cryogenic refrigeration apparatus includes a compressor, a plurality of refrigerators, and a gas line configured to connect the plurality of refrigerators to the compressor in parallel so as to circulate a working gas between each of the plurality of refrigerators and the compressor. The gas line may include a flow rate control valve capable of individually controlling a pressure drop of a flow of working gas in a corresponding one of the plurality of refrigerators. The flow rate control valve may be provided in series with the corresponding refrigerator.

6 Claims, 2 Drawing Sheets

CRYOGENIC REFRIGERATION APPARATUS AND METHOD OF CONTROLLING CRYOGENIC REFRIGERATION APPARATUS

BACKGROUND OF THE INVENTION

1. Field of the Invention

The present invention relates to a cryogenic refrigeration apparatus and a method of controlling a cryogenic refrigeration apparatus.

2. Description of the Related Art

There is known a refrigeration device of cold storage type configured to supply a high-pressure helium gas compressed by a compressor to a refrigerator and return a low-pressure helium gas expanded in the refrigerator to have a reduced pressure back to the compressor, wherein a temperature sensor is provided on the refrigerator side and a bypass passage having a flow rate control valve controlled by a signal from the temperature sensor is provided so that the temperature of the refrigerator is controlled by controlling a pressure difference between the high-pressure side and the low-pressure side of the working gas.

In the refrigeration device described above, one refrigerator is provided for one compressor. In some devices available recently, a plurality of refrigerators are provided for one compressor in order to save energy and reduce cost. For example, the plurality of refrigerators are mounted at a plurality of locations in a given large-sized device or mounted in a plurality of devices of similar type, respectively. In such extremely low temperature refrigeration devices, the common compressor is used to simultaneously operate the plurality of refrigerators, which may be referred to as multi-operation.

SUMMARY OF THE INVENTION

An exemplary object according to an aspect of the present invention is to adjust the refrigeration capacity of an individual refrigerator in a cryogenic refrigeration apparatus having a plurality of refrigerators and capable of multi-operation.

According to one embodiment of the present invention there is provided a cryogenic refrigeration apparatus including: a working gas source; a plurality of refrigerators; and a gas line configured to connect the working gas source to the plurality of refrigerators in parallel so as to circulate the working gas between each of the plurality of refrigerators and the working gas source, wherein the gas line includes a control element capable of individually controlling a pressure drop of a flow of working gas in a corresponding one of the plurality of refrigerators, and the control element is provided in series with the corresponding refrigerator.

According to another embodiment of the present invention, there is provided a method of controlling a cryogenic refrigeration apparatus including: operating a plurality of refrigerators simultaneously using a common working gas source; and individually controlling a pressure drop of a flow of working gas between the working gas source and the plurality of refrigerators.

Optional combinations of the aforementioned constituting elements, and implementations of the invention in the form of methods, apparatuses, and systems may also be practiced as additional modes of the present invention.

BRIEF DESCRIPTION OF THE DRAWINGS

Embodiments will now be described, by way of example only, with reference to the accompanying drawings which are meant to be exemplary, not limiting, and wherein like elements are numbered alike in several Figures, in which.

DETAILED DESCRIPTION OF THE INVENTION

The invention will now be described by reference to the preferred embodiments. This does not intend to limit the scope of the present invention, but to exemplify the invention.

Figure 1:
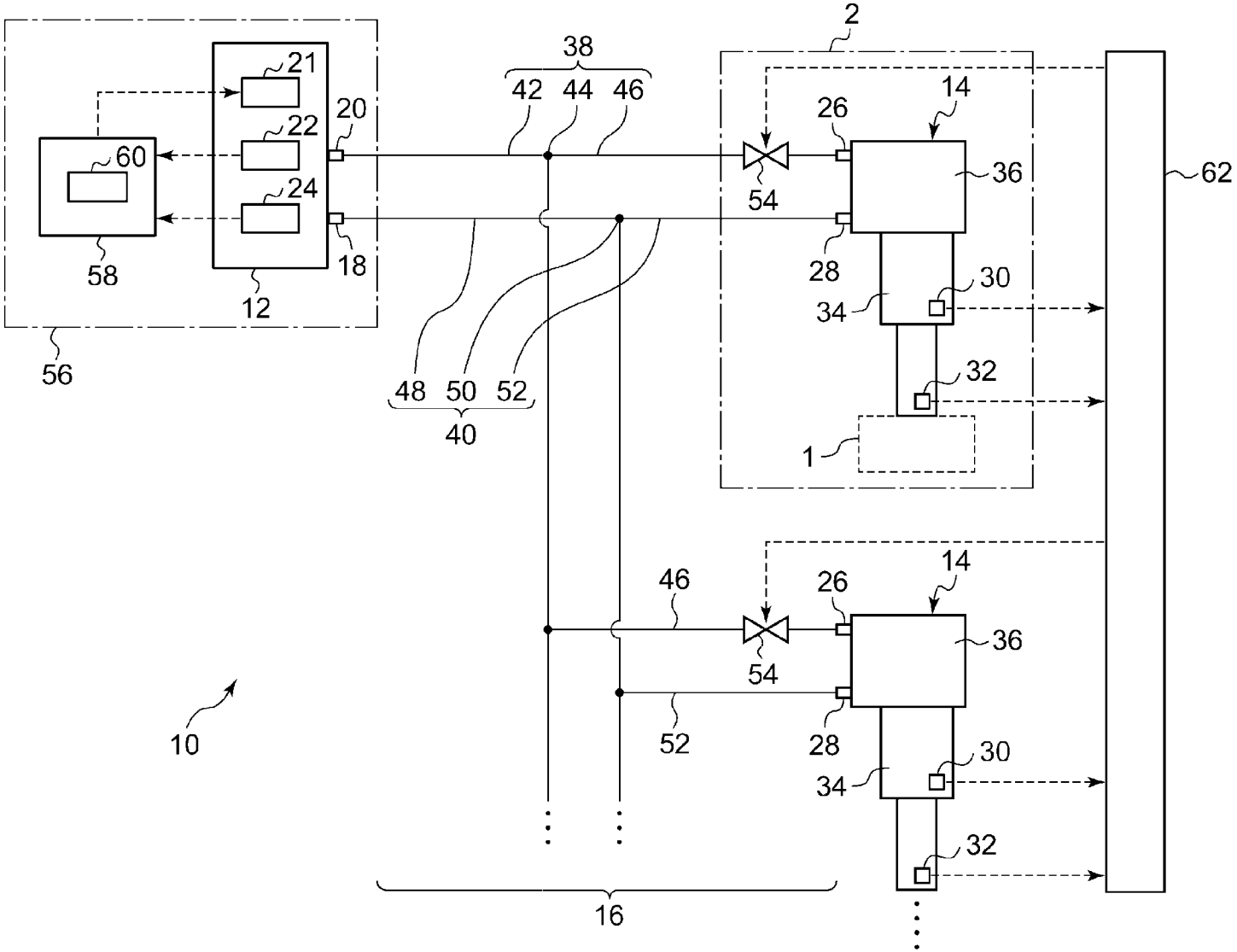
FIG. 1 schematically shows the overall structure of the extremely low temperature refrigeration device according to an embodiment of the present invention.

FIG. 1 schematically shows the overall structure of a cryogenic refrigeration apparatus 10 according to an embodiment of the present invention. In this embodiment, the cryogenic refrigeration apparatus 10 is provided in a device 2 including an object 1 subject to cooling such as a superconducting equipment or any other devices. For example, the device 2 is a nuclear magnetic resonance imaging apparatus. In this case, the object 1 to be cooled is a superconducting magnet. The device 2 may be a cryopump. In this case, the object 1 to be cooled is a cryopanel.

The cryogenic refrigeration apparatus 10 comprises a working gas source including a compressor 12, and a plurality of refrigerators 14. The cryogenic refrigeration apparatus 10 further comprises a gas line 16 connecting the plurality of refrigerators 14 to the compressor 12 in parallel. The gas line 16 is configured to circulate the working gas between the compressor 12 and each of the plurality of refrigerators 14. For example, the working gas is a helium gas.

The compressor 12 comprises an inlet port 18 for receiving a low-pressure working gas from the gas line 16 and an outlet port 20 for delivering a high-pressure working gas to the gas line 16. The compressor 12 comprises a compressor body (not shown) configured to compress the working gas and a compressor motor 21 configured to drive the compressor body. The compressor 12 comprises a first pressure sensor 22 configured to measure the pressure of the low-pressure working gas and a second pressure sensor 24 configured to measure the high-pressure working gas. These pressure sensors may be provided at appropriate locations in the gas line 16.

The refrigerator 14 is an extremely low temperature refrigerator of cold storage type such as a Gifford-McMahon refrigerator (so-called a GM refrigerator) and a pulse tube refrigerator, for example. The refrigerator 14 comprises a high-pressure port 26 for receiving a high-pressure working gas from the gas line 16 and a low-pressure port 28 for delivering the low-pressure working gas to the gas line 16. The refrigerator 14 comprises at least one temperature sensor configured to measure the cooling temperature of the refrigerator 14. For example, the refrigerator 14 is a two-stage refrigerator. In this case, the refrigerator 14 comprises a first temperature sensor 30 for measuring the temperature of the low-temperature end of the first stage and a second temperature sensor 32 for measuring the temperature of the low-temperature end of the second stage.

The refrigerator 14 comprises an expansion chamber 34 of the working gas. A regenerator (not shown) is accommodated in the expansion chamber 34. The refrigerator 14 comprises a driver unit 36 for running heat cycles at a certain frequency. The driver unit 36 is configured to drive the refrigerator 14 at a constant heat cycle frequency. In this heat cycle, the high-pressure working gas is supplied from the high-pressure port 26 to the expansion chamber 34 via the regenerator and is expanded and cooled in the expansion chamber 34. The working gas with a reduced pressure is discharged from the expansion chamber 34 to the low-pressure port 28 via the regenerator.

In a case where the refrigerator 14 is a GM refrigerator, for example, the driver unit 36 comprises a displacer mechanism, a passage switching mechanism, and a drive source. The displacer mechanism is configured to supply the high-pressure working gas to the expansion chamber 34 via the regenerator and discharge the low-pressure working gas out of the expansion chamber 34 via the regenerator. The regenerator is built in the displacer mechanism. The passage switching mechanism is configured to switch the destination of connection of the expansion chamber 34 between the high-pressure port 26 and the low-pressure port 28. The drive source is configured to drive the displacer mechanism and the passage switching mechanism in a synchronized manner so as to achieve the heat cycle (i.e., GM cycle).

The gas line 16 comprises a high-pressure line 38 configured to supply the high-pressure working gas from the compressor 12 to the plurality of refrigerators 14 and a low-pressure line 40 configured to collect the low-pressure working gas from the plurality of refrigerators 14 to the compressor 12. The high-pressure line 38 connects the outlet port 20 of the compressor 12 to the high-pressure port 26 of each refrigerator 14. The low-pressure line 40 connects the inlet port 18 of the compressor 12 to the low-pressure port of each refrigerator 14.

The high-pressure line 38 comprises a main high-pressure pipe 42, a high-pressure branch 44, and a plurality of individual high-pressure pipes 46. The main high-pressure pipe 42 connects the outlet port 20 of the compressor 12 to the high-pressure branch 44. The high-pressure branch 44 causes the main high-pressure pipe 42 to branch into the individual high-pressure pipes 46. Each of the plurality of individual high-pressure pipes 46 connects the high-pressure branch 44 to the high-pressure port 26 of the corresponding refrigerator 14.

Similarly, the low-pressure line 40 comprises a main low-pressure pipe 48, a low-pressure branch 50, and a plurality of individual low-pressure pipes 52. The main low-pressure pipe 48 connects the inlet port 18 of the compressor 12 to the low-pressure branch 50. The low-pressure branch 50 causes the main low-pressure pipe 48 to branch into the individual low-pressure pipes 52. Each of the plurality of individual low-pressure pipes 52 connects the low-pressure branch 50 to the low-pressure port 28 of the corresponding refrigerator 14.

Thus, the main high-pressure pipe 42 and the main low-pressure pipe 48 constitute the main passage of the gas line 16. The individual high-pressure pipes 46 and the individual low-pressure pipes 52 constitute the individual passages of the gas line 16. The compressor 12 is provided in the main passage. In each of individual passages is provided the corresponding refrigerator 14. The refrigerators 14 are connected to the main passage via the respective individual passages. The main passage and the individual passages form a passage to circulate the working gas between the compressor 12 and the refrigerators 14.

The gas line 16 comprises a plurality of flow rate control valves 54. The number of the flow control valves 54 is the same as that of the refrigerators 14. Each of the flow rate control valves 54 is provided in series with the corresponding refrigerator 14. Each of the flow rate control valve 54 is provided in the individual high-pressure pipe 46 and is adjacent to the high-pressure port 26 of the refrigerator 14 on its outside. The flow rate control valves 54 are provided in the gas line 16 in one-to-one correspondence with the refrigerators 14.

The degree of valve opening of the flow rate control valve 54 is controlled to adjust a pressure drop $\Delta P1$ in the individual high-pressure pipe 46, thereby controlling the flow rate of working gas in the individual high-pressure pipe 46. For example, the flow rate control valve 54 performs so-called Cv value control. Since each of the flow rate control valves 54 is provided in the corresponding individual passage of the gas line 16, the pressure drop $\Delta P1$ of the flow of gas supplied to the corresponding refrigerator 14 can be individually controlled.

Providing the flow rate control valve 54 in the individual high-pressure pipe 46 may be more advantageous than providing it in the individual low-pressure pipe 52. Because the pressure drop $\Delta P1$ is created on the high-pressure side of the refrigerator 14, the operating pressure of the refrigerator 14 can be lowered. Accordingly, an adverse effect of a possible pressure drop in the refrigerator 14 on its refrigeration capacity can be reduced.

The flow rate control valve 54 may be mounted on the refrigerator 14 to form an integrated refrigerator unit. Alternatively, the flow rate control valve 54 may be a pressure drop control element provided separately from the refrigerator 14 and connected to the refrigerator 14 by a pipe.

The cryogenic refrigeration apparatus 10 comprises a compressor unit 56. The compressor unit 56 comprises the compressor 12 and a compressor controller 58 configured to control the compressor 12. The compressor controller 58 comprises a compressor inverter 60 capable of changing the operating frequency of the compressor motor 21. The compressor controller 58 is configured to control the operating frequency of the compressor motor 21 based on the pressure measured by the first pressure sensor 22 and/or the second pressure sensor 24.

For example, the compressor controller 58 may control the compressor 12 such that a pressure difference between the high pressure and the low pressure of the compressor 12 is substantially at a target pressure. Hereinafter, this may be referred to as constant pressure difference control. The compressor controller 58 controls the operating frequency of the compressor 12 for the constant pressure difference control. Alternatively, the target pressure difference may be changed during the constant pressure difference control.

In the constant pressure difference control, the compressor controller 58 determines a pressure difference between the pressure measured by the first pressure sensor 22 and the pressure measured by the second pressure sensor 24. The compressor controller 58 determines the operating frequency of the compressor motor 21 to cause the pressure difference match the target value $\Delta P$. The compressor controller 58 controls the compressor inverter 60 so as to achieve the operating frequency.

The cryogenic refrigeration apparatus 10 comprises a temperature controller 62 configured to control the cooling temperatures of the plurality of refrigerators 14. The temperature controller 62 is configured to control the plurality of flow rate control valves 54 individually based on the temperature measured by the first temperature sensor 30 and/or the second temperature sensor 32 of the corresponding one of the plurality of refrigerators 14.

The temperature controller 62 controls the refrigerator 14 such that the cooling temperature of the first stage (or the second stage) of the refrigerator 14 is substantially at a target temperature. The temperature controller 62 controls the valve opening position of the flow rate control valve 54 corresponding to a given refrigerator 14 so that the temperature measured by the first temperature sensor 30 of the refrigerator 14 matches the target temperature. The target temperature may be constant or changed during the operation of the refrigerator 14. Such temperature control is performed during the steady cooling operation of the refrigerator 14.

Alternatively, the temperature controller 62 may control the flow rate control valve 54 so that the cooling temperature of the first stage (or the second stage) of the refrigerator 14 is changed. The temperature controller 62 may control the flow rate control valve 54 corresponding to a given refrigerator 14 in accordance with the operating status of the refrigerator 14. For example, the flow rate control valve 54 may be opened to a certain position (e.g., the valve may be fully opened) during the initial operation of the refrigerator 14 and driven to a less open position during steady operation following the initial operation.

A description will be given of the operation of the cryogenic refrigeration apparatus 10. The operation of the compressor 12 provides a pressure difference corresponding to a target pressure difference ΔP between the main high-pressure pipe 42 and the main low-pressure pipe 48 of the gas line 16. In other words, denoting the intake pressure of the compressor 12 by P, the discharge pressure of the compressor 12 is denoted by P+ΔP. Therefore, the high-pressure working gas having the pressure P+ΔP is delivered from the compressor 12 to the high-pressure line 38. The high-pressure gas from the compressor 12 is distributed via the main high-pressure pipe 42 to the individual high-pressure pipes 46 at the high-pressure branch 44. While the expansion chamber 34 of the refrigerator 14 is connected to the individual high-pressure pipe 46, the high-pressure operating gas is supplied from the high-pressure line 38 to the expansion chamber 34.

The high-pressure working gas is supplied to the corresponding refrigerator 14 via the flow rate control valve 54 of the individual high-pressure pipe 46. The flow rate control valve 54 provides a pressure drop ΔP1 to the flow of working gas in the individual high-pressure pipe 46. Therefore, the working gas having a pressure P+ΔP−ΔP1 is supplied to the expansion chamber 34 of the refrigerator 14.

When the expansion chamber 34 is connected to the individual low-pressure pipe 52, the high-pressure working gas is expanded in the expansion chamber 34 so that a pressure-volume (PV) work is done and cold heat is generated in the refrigerator 14. The pressure of the working gas is lowered from P+ΔP−ΔP1 to P. In other words, the difference between the intake pressure and the discharge pressure of the expansion chamber 34 is ΔP−ΔP1, which will be represented as ΔP2 hereinafter (i.e., ΔP2=ΔP−ΔP1).

The low-pressure working gas is discharged from the expansion chamber 34 to the low-pressure line 40. The low-pressure working gas leaves the refrigerator 14 and reaches the low-pressure branch 50 via the individual low-pressure pipe 52. The low-pressure working gas returns to the compressor 12 via the main low-pressure pipe 48. In this way, the low-pressure working gas having the pressure P is collected from the low-pressure line 40 to the compressor 12. The compressor 12 compresses the collected working gas and raises the pressure to P+ΔP. The resultant high-pressure working gas is supplied again from the compressor 12 to the refrigerator 14.

Generally, the refrigeration capacity of the refrigerator is correlated to the product of the difference between the intake pressure and the discharge pressure of the expansion chamber and the volume of the expansion chamber, i.e., the PV work (ideally, the refrigeration capacity is equal to the PV work). In a typical refrigerator, the refrigeration capacity is controlled by changing the heat cycle frequency and the cooling temperature is adjusted accordingly. Conceptually, this is equivalent to adjusting the volume V of the expansion chamber. The volume V is a parameter determining the PV work.

In contrast, the present embodiment is based on a concept of adjusting the pressure difference P, which determines the PV work of the refrigerator 14. The refrigeration capacity of the refrigerator 14 is correlated to the product ΔP2*V of the pressure difference ΔP2 between the intake pressure and the discharge pressure of the expansion chamber 34 and the volume V of the expansion chamber 34. As described above, the pressure difference ΔP2 of the expansion chamber 34 is determined by the pressure difference ΔP of the compressor 12 and the pressure drop ΔP1 of the flow rate control valve 54. Therefore, by changing the pressure drop Δp1, the refrigeration capacity of the refrigerator 14 can be controlled and the cooling temperature can be adjusted accordingly.

If a given flow rate control valve 54 is driven to a less open position, the pressure drop ΔP1 is then increased. This causes a complementary reduction in the pressure difference ΔP2(=ΔP−ΔP1) of the expansion chamber 34 of the refrigerator 14 corresponding to the given flow rate control valve 54 and thereby the PV work in the refrigerator 14 is reduced. Therefore, the refrigeration capacity of the refrigerator 14 is reduced so that the temperature of the refrigerator 14 is raised. Conversely, if the flow rate control valve 54 is driven to a more open position, the pressure drop ΔP1 is then reduced. This causes a complementary increase in the pressure difference ΔP2 of the expansion chamber 34 and thereby the PV work of the refrigerator 14 is increased. Therefore, the refrigeration capacity of the refrigerator 14 is increased and the temperature of the refrigerator 14 is lowered.

Since the compressor 12 is a single gas source common to the plurality of refrigerators 14, the pressure difference ΔP of the compressor 12 is also common to the plurality of refrigerators 14. Therefore, adjustment of the pressure difference of the compressor does not result in individual temperature control of the refrigerators 14. According to the present embodiment, however, the pressure drop ΔP1 of the flow rate control valve 54 can be controlled for each refrigerator 14 so that the refrigeration capacities of the plurality of refrigerators 14 can be individually controlled.

According to the present embodiment, a novel temperature control method is provided that substitutes the existing temperature control whereby the heat cycle frequency of the refrigerator is changed. The novel method can be implemented by a simple structure in which the flow rate control valve 54 is provided in the gas line 16 and so could provide an advantage over the existing method in terms of the cost.

In further accordance with the present embodiment, there is no need to change the heat cycle frequency of the refrigerator 14 so that a cryogenic refrigeration apparatus 10 including an inverter-less refrigerator 14 can be provided. By not providing the refrigerator 14 with an inverter, noise originating from an inverter is eliminated. Accordingly, the cryogenic refrigeration apparatus 10 is suitable to cool a device in which noise reduction is demanded (e.g., nuclear magnetic resonance imaging apparatus).

In the present embodiment, flow control of the gas line 16 is coordinated with the constant pressure difference control of the compressor. This helps improve the power saving performance of the cryogenic refrigeration apparatus 10. When the flow rate control valve 54 is driven to a less open position, it is more difficult for the working gas to flow in the gas line 16 so that the pressure difference in the compressor 12 is increased. This causes the operating frequency of the compressor 12 to be lowered so as to return the pressure difference to the target value. This reduces the power consumption of the compressor 12. Thus, by driving the flow rate control valve 54 to a less open position in order to prevent the refrigerator 14 from exhibiting excessive refrigeration capacity, it is also possible to reduce the power consumption of the compressor 12. Conversely, by opening the flow rate control valve 54 as needed, the refrigeration capacity of the refrigerator 14 can be enhanced and the operating frequency of the compressor 12 can be raised. In comparison with the case of operating the compressor at a high frequency constantly, the power consumption of the compressor 12 can be reduced.

If a bypass passage is provided between the high-pressure side and the low-pressure side of the compressor, the energy consumed to compress the high-pressure gas flowing in the bypass passage does not contribute to the refrigeration capacity of the refrigerator. In contrast, the cryogenic refrigeration apparatus 10 according to the present embodiment is not provided with a bypass passage so that energy is not consumed due to the bypassing. This is also useful in saving energy.

Figure 2:
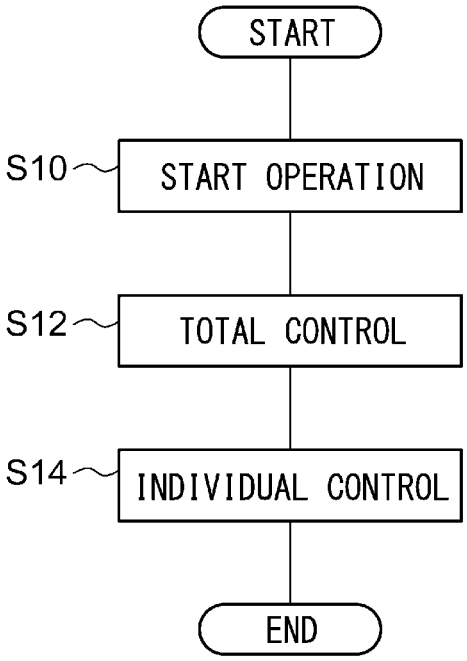
FIG. 2 is a flowchart showing a method of controlling the extremely low temperature refrigeration device according to an embodiment of the present invention.

FIG. 2 is a flowchart showing a method of controlling the cryogenic refrigeration apparatus 10 according to an embodiment of the present invention. The method is run by, for example, the temperature controller 62. As shown in the figure, the operation of the cryogenic refrigeration apparatus 10 is started (S10). The plurality of refrigerators 14 are operated simultaneously by using the common compressor 12.

The control method includes total control (S12) of the plurality of refrigerators 14 and individual control (S14) of the refrigerators 14. Total control includes cooling the refrigerators 14 from an initial temperature (e.g., room temperature) toward the target temperature, while monitoring the cooling temperature of the refrigerators 14 individually. In total control, the flow rate control valves 54 are configured at a certain valve opening position (e.g., fully open). When any of the refrigerators 14 reaches the target temperature, temperature controller 62 terminates total control and makes a transition to individual control. Individual control includes individually controlling the pressure drop in the individual passage corresponding to each of the plurality of refrigerators 14. In individual control, the flow rate control valve 54 is controlled. In other words, total control is rough temperature adjustment and individual control is precise temperature adjustment. In an alternative embodiment, the temperature controller 62 may start individual control when the operation of the cryogenic refrigeration apparatus 10 is started.

For example, all of the plurality of refrigerators 14 are cooled below the target temperature according to total control. When the refrigerator 14 at the highest temperature is cooled to the target temperature, the temperature controller 62 terminates total control and makes a transition to individual control. At this point of time, the other refrigerators 14 are cooled to a temperature lower than the target temperature. In individual control, the flow rate control valve 54 is driven to a less open position so that the cooling temperature of the corresponding refrigerator 14 is raised to the target temperature. In this way, each of the plurality of refrigerators 14 can be cooled to the target temperature.

The behavior of the refrigerators 14 varies depending on factors such as differences between the refrigerators 14 or the relative positions of the refrigerators 14 from the compressor 12. For example, the cooling temperature may vary between the refrigerators 14. Individual control of the refrigerators 14 can reduce variation in the behavior.

Described above is an explanation based on an exemplary embodiment. The embodiment is intended to be illustrative only and it will be obvious to those skilled in the art that various modifications to designs and variations could be developed and that such modifications and variations are also within the scope of the present invention.

The cryogenic refrigeration apparatus 10 according to the embodiment described above is provided with one compressor 12. Alternatively, the cryogenic refrigeration apparatus 10 may comprise a working gas source including a plurality of compressors 12. In this case, the plurality of compressors 12 may be connected in parallel with the plurality of refrigerators 14. In other words, the gas line 16 may be configured such that the plurality of compressors 12 are connected in parallel to all of the plurality of refrigerators 14. For example, the gas line 16 may be configured such that the main high-pressure pipe 42 and the main low-pressure pipe 48 are provided for each compressor 12, and the main high-pressure pipe 42 and the main low-pressure pipe 48 may be connected to the high-pressure branch 44 and the low-pressure branch 50, respectively. Therefore, the gas line 16 may comprise a plurality of main high-pressure pipes 42 and a plurality of main low-pressure pipes 48, the high-pressure branch 44 and the low-pressure branch 50, and the plurality of individual high-pressure pipes 46 and the plurality of individual low-pressure pipes 52.

In the embodiment described above, the gas line 16 is provided with the flow rate control valve 54 for control of the pressure drop in the flow of working gas. However, the flow rate control valve 54 may not necessarily be used for pressure drop control of the working gas. The gas line 16 may comprise a flow rate control mechanism such as an on-off valve or a variable throttle for controlling the flow of working gas or an alternative pressure drop control element. For example, the variable throttle encompasses a flow rate control valve 54 and a variable orifice.

The pressure drop control element may be provided at an arbitrary location (e.g., the individual low-pressure pipe 52) in the individual passages of the gas line 16 or in the refrigerator 14. A plurality of pressure drop control elements may be provided in one refrigerator. For example, a plurality of flow rate control valves 54 or variable throttles may be provided in series in the individual high-pressure pipe 46 and/or the low-pressure pipe 52.

The pressure drop control element may comprise a plurality of branch passages. For example, the pressure drop control element comprises a first branch passage forming a part of the individual passages of the gas line 16 and a second branch passage provided in parallel with the first branch passage. The first branch passage is open while the second branch passage is provided with a variable throttle such as a flow rate control valve. Provision of the first branch passage ensures a flow in the individual passages. The flow rate in the individual passages can be controlled by changing the flow rate in the second branch passage as needed.

The cryogenic refrigeration apparatus 10 may be provided with pressure drop control elements smaller in number than the refrigerators 14. In this case, some of the plurality of refrigerators 14 may be associated one to one with the pressure drop control elements. The refrigeration capacity of those refrigerators 14 are controlled by using the pressure drop control elements and the pressure drop control elements are not used for the other refrigerators 14. Heat cycle frequency control or other refrigeration capacity control may be used in the other refrigerators 14.

Alternatively, the plurality of refrigerators 14 may be organized into several groups and one pressure drop control element may be provided for each group so that the refrigeration capacity of the refrigerators 14 in a group is controlled by using the associated pressure drop control element.

In the embodiment described above, the driver unit 36 of the refrigerator 14 is configured to operate the refrigerator 14 at a constant heat cycle frequency. Alternatively, the driver unit 36 may be configured to change the heat cycle frequency. By combining heat cycle frequency control of the refrigerators 14 and flow rate control of the gas line 16, the range of controlling the refrigeration capacity of the refrigerators 14 can be enlarged.

The refrigerator 14 may comprise a heater. In this case, the heater may be used to raise the temperature of the refrigerator 14 in individual control.

It should be understood that the invention is not limited to the above-described embodiment, but may be modified into various forms on the basis of the spirit of the invention. Additionally, the modifications are included in the scope of the invention.

Priority is claimed to Japanese Patent Application No. 2013-41438, filed on Mar. 4, 2013, the entire content of which is incorporated herein by reference.

What is claimed is:

1. A cryogenic refrigeration apparatus comprising:

a working gas source;

a plurality of refrigerators; and a gas line configured to connect the working gas source to the plurality of refrigerators in parallel so as to circulate the working gas between each of the plurality of refrigerators and the working gas source, wherein the gas line comprises a control element capable of individually controlling a pressure drop of a flow of working gas in a corresponding one of the plurality of refrigerators, and the control element is provided in series with the corresponding refrigerator.

2. The cryogenic refrigeration apparatus according to claim 1, wherein the working gas source comprises at least one compressor, and the cryogenic refrigeration apparatus further comprises a compressor controller configured to control an operating frequency of the compressor such that a pressure difference between a high pressure and a low pressure of the compressor is substantially at a target pressure.

3. The cryogenic refrigeration apparatus according to claim 1, further comprising a temperature controller configured to control the control element such that a cooling temperature of the corresponding refrigerator is substantially at a target temperature.

4. The cryogenic refrigeration apparatus according to claim 1, wherein the gas line comprises a main passage connected to the working gas source and an individual passage that connects the corresponding refrigerator to the main passage, and the control element comprises a variable throttle provided in the individual passage.

5. A cryopump comprising the cryogenic refrigeration apparatus according to claim 1.

6. A nuclear magnetic resonance imaging apparatus comprising the cryogenic refrigeration apparatus according to claim 1.

* * * * *